US006645026B2

(12) United States Patent
Kuan

(10) Patent No.: US 6,645,026 B2
(45) Date of Patent: Nov. 11, 2003

(54) WATER SKIING FLOAT, JACKET ATTACHMENT STRUCTURE

(76) Inventor: Frank C. Kuan, P.O.Box 24-108, Taipei (TW)

( * ) Notice: Subject to any disclaimer, the term of this patent is extended or adjusted under 35 U.S.C. 154(b) by 0 days.

(21) Appl. No.: 10/100,293

(22) Filed: Mar. 19, 2002

(65) Prior Publication Data

US 2003/0181107 A1 Sep. 25, 2003

(51) Int. Cl.[7] ..... B63B 35/607
(52) U.S. Cl. ..... 441/40; 114/345
(58) Field of Search ..... 114/345; 441/40–42

(56) References Cited

U.S. PATENT DOCUMENTS 3,653,084 A * 4/1972 Hartman ..... 441/40
4,159,551 A * 7/1979 Iwai ..... 114/345
4,329,751 A * 5/1982 Cigognetti ..... 114/345

* cited by examiner

*Primary Examiner*—Jesus D. Sotelo
(74) *Attorney, Agent, or Firm*—Troxell Law Office PLLC

(57) ABSTRACT

A water skiing float, jacket attachment structure consisting of a jacket externally sleeved around the water skiing float utilized for protection, towing, and grasping which has through-holes of identical size disposed in alignment with input/output air stems projecting from the water skiing float such that after being fitted over them, sealing retainers clip it onto water skiing float. After sleeving around the water skiing float, there are round, tooth-shaped ligature openings in an alternating arrangement along its interior edge, with each ligature opening having a perforation at its lateral margin through which a rope is threaded for binding and attachment around the inside of the water skiing float. As such, when utilized at rapid speed or in powerful currents, the practical invention herein prevents the dislodging of the water skiing float, the easy movement of the jacket, and the unrestrained tearing of the ligature openings that could result in injury.

2 Claims, 4 Drawing Sheets

WATER SKIING FLOAT, JACKET ATTACHMENT STRUCTURE

BACKGROUND OF THE INVENTION

1) Field of the Invention

The invention herein relates to a water skiing float, jacket attachment structure that addresses the securing and safety drawbacks of water skiing float and jacket conjoinment through an improved design consisting of a jacket externally sleeved around the water skiing float utilized for protection, towing, and grasping which has through-holes of identical size disposed in alignment with input/output air stems projecting from the water skiing float such that after being fitted over them, sealing retainers clip it onto water skiing float. After sleeving around the water skiing float, there are round, tooth-shaped ligature openings in an alternating arrangement along its interior edge, with each ligature opening having a perforation at its lateral margin through which a rope is threaded for binding and attachment around the inside of the water skiing float. As such, when utilized at rapid speed or in powerful currents, the practical invention herein prevents the dislodging of the water skiing float, the easy movement of the jacket, and the unrestrained tearing of the ligature openings that could result in injury.

2) Description of the Related Art

Due the growing importance of leisure activities, more and more people flock to the sea and lakes during the summer to enjoy aquatic amusements such as riding recreational water skiing floats towed by boats or moored in currents. In addition to being of relatively large dimensions, many are typically constructed of welded PVC material for reasons of production cost and method. However, since their coarseness easily results in abrasive injuries, water skiing floats are often equipped with a protective jacket made of nylon or other similar material. Conventional jackets are convenient to ensleeve and most have ligature openings with perforations for various hook and loop, cord, and snap fixtures to achieve attachment. However, in situations of high towing speeds or riding powerful currents that impose imbalanced or excessive pulling forces, since the jacket readily moves or the ligature openings eventually tear, and the user consequently slips into the water and is susceptible to accidental injury, an improved design is necessary.

In view of the said situation, the inventor of the invention herein conducted research on the said shortcomings as well as methods of improvement based on several decades of experience gained in the manufacturing and design of water skiing floats which, following extensive experimentation and testing, culminated in the successful development of the water skiing float, jacket attachment structure of the invention herein.

SUMMARY OF THE INVENTION

The primary objective of the invention herein is to provide a water skiing float, jacket attachment structure consisting of a jacket externally sleeved around the water skiing float utilized for protection, towing, and grasping which has through-holes of identical size disposed in alignment with input/output air stems projecting from the water skiing float such that after being fitted over them, sealing retainers clip it onto water skiing float. After sleeving around the water skiing float, there are round, tooth-shaped ligature openings in an alternating arrangement along its interior edge, with each ligature opening having a perforation at its lateral margin through which a rope is threaded for binding and attachment around the inside of the water skiing float. As such, when utilized at rapid speed or in powerful currents, the practical invention herein prevents the dislodging of the water skiing float, the easy movement of the jacket, and the unrestrained tearing of the ligature openings that could result in injury.

To enable the examination committee to further understand the structure and functions of the present invention, the brief description of the drawings below are followed by the detailed description of the invention herein.

DETAILED DESCRIPTION OF THE INVENTION

Figure 1:
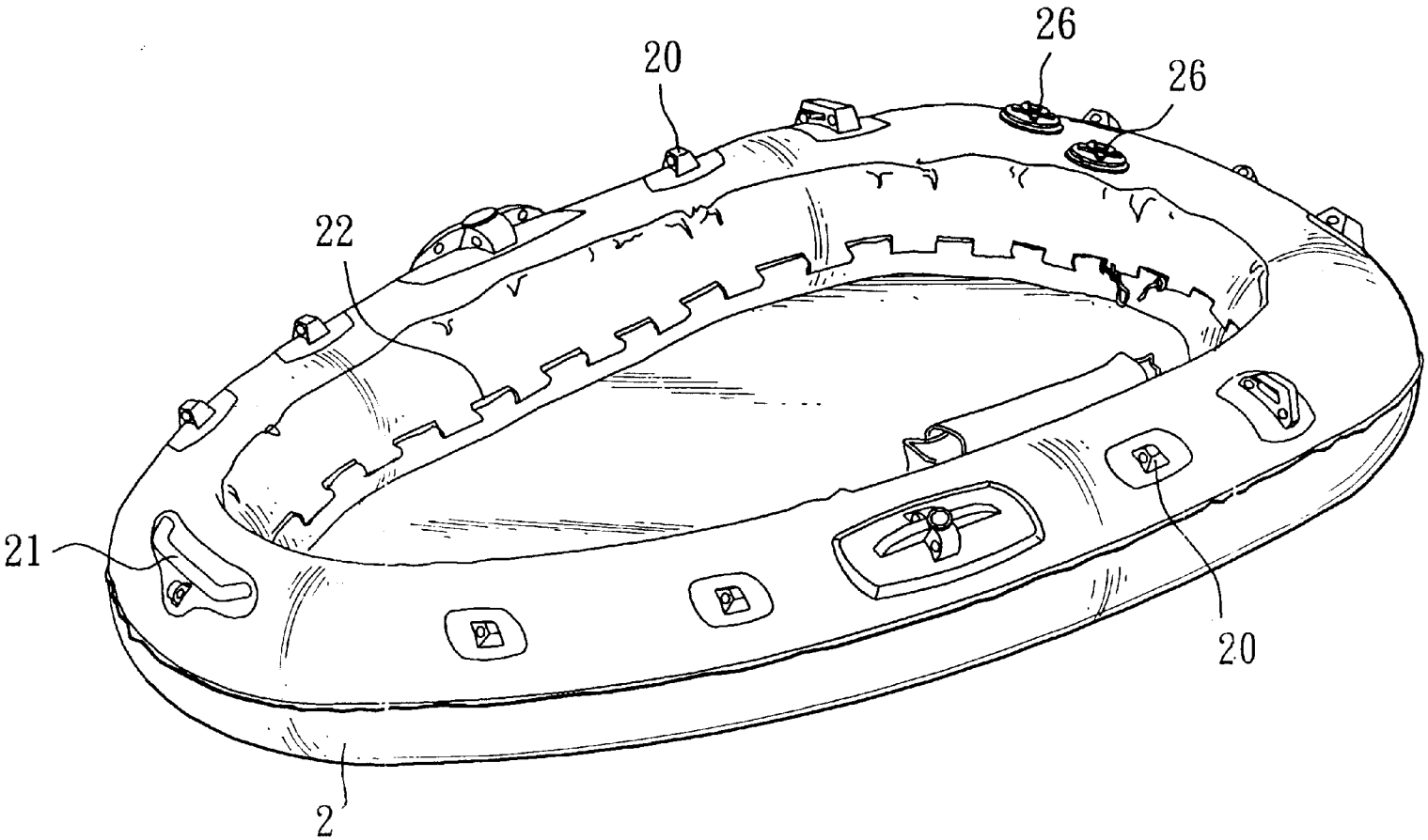
FIG. 1 is an isometric drawing of an embodiment of the invention herein.
Figure 2:
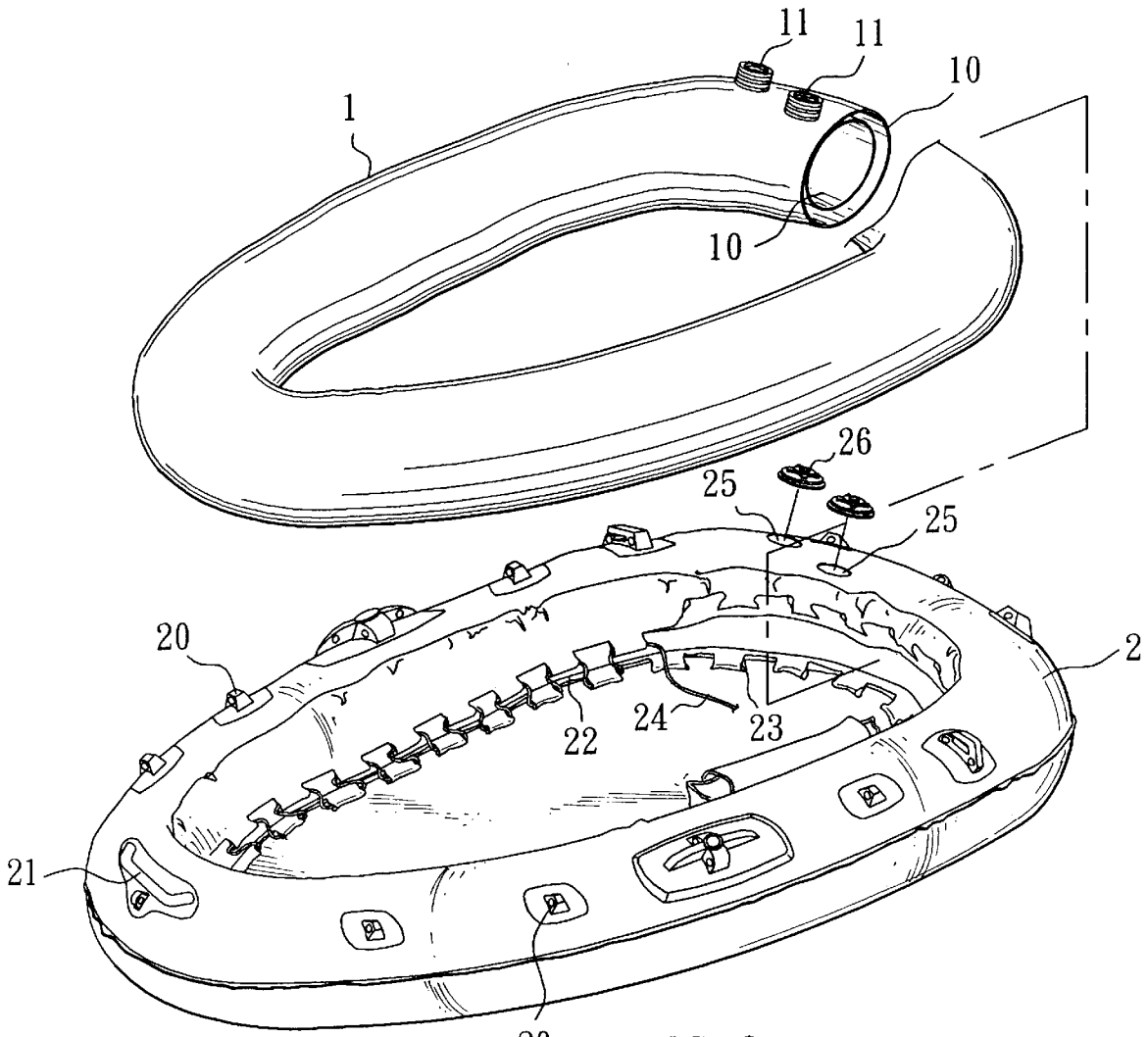
FIG. 2 is an exploded drawing of the embodiment of the invention herein.
Figure 3:
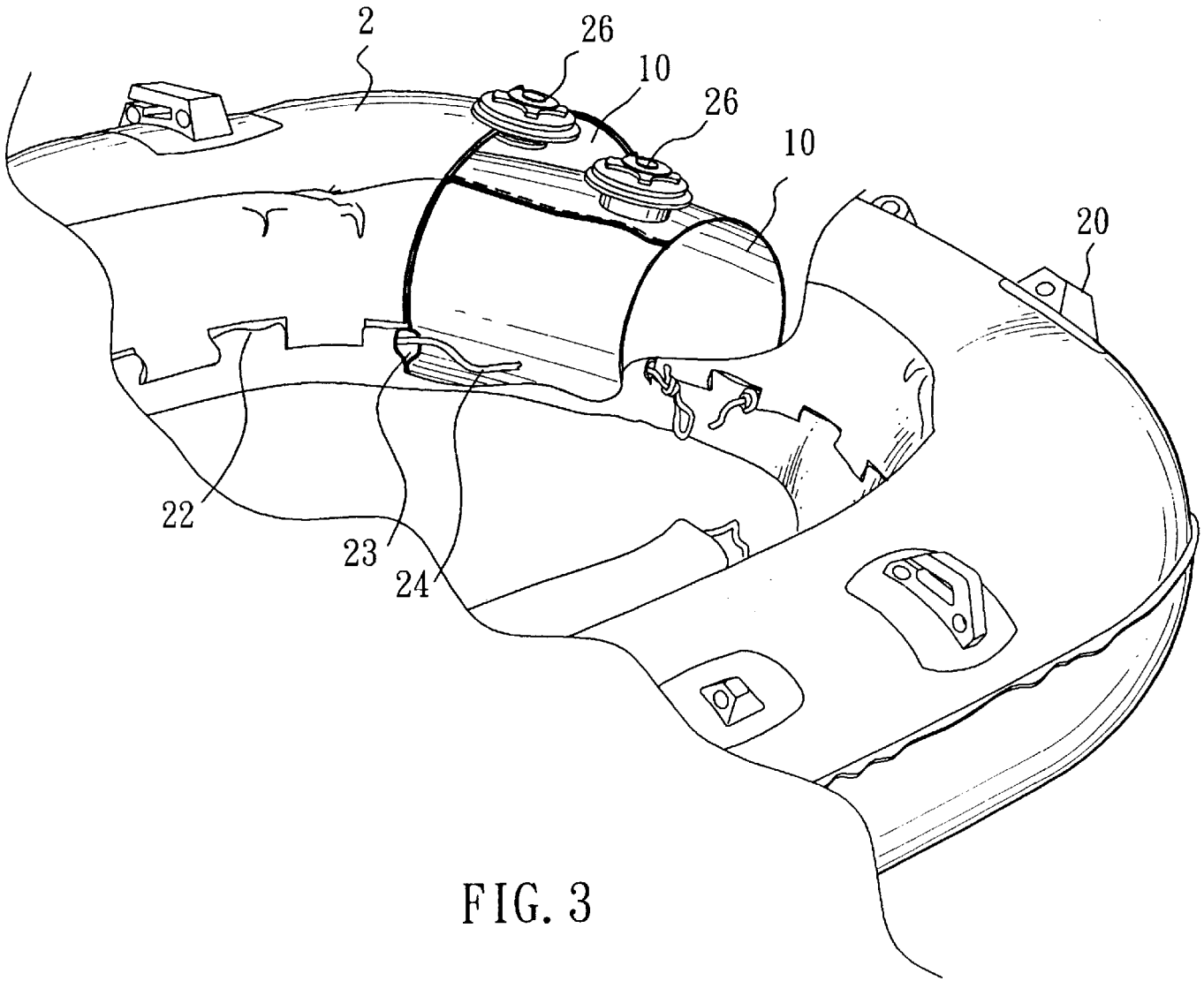
FIG. 3 is a cross-sectional drawing of a portion of the embodiment of the invention herein, as viewed from an isometric perspective.
Figure 4:
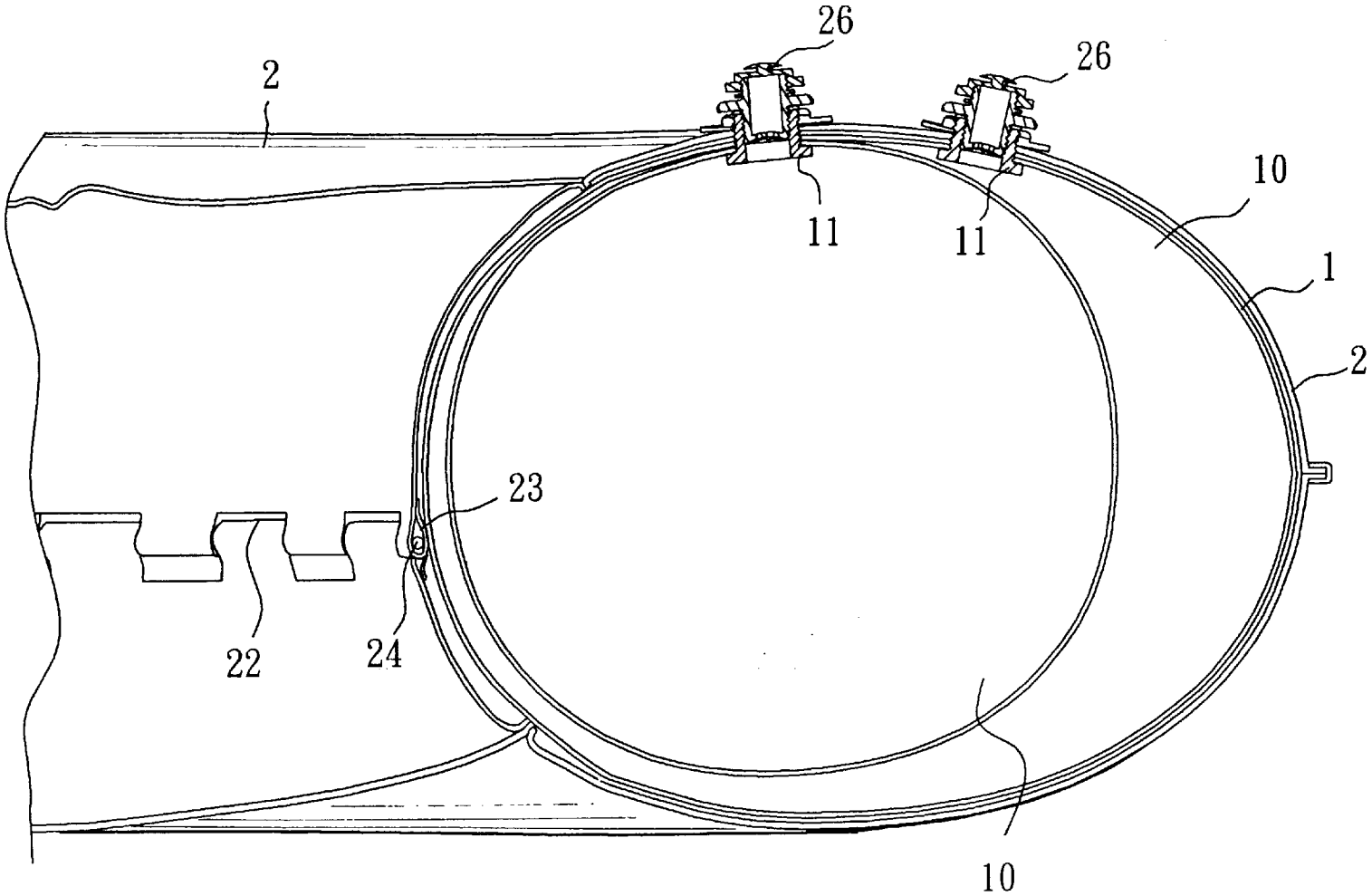
FIG. 4 is a cross-sectional drawing of a portion of the embodiment of the invention herein.

Referring to the drawings, the invention herein is comprised of a water skiing float 1 and a jacket 2; the said water skiing float 1 is an inflated boat-shaped body that is internally fabricated with two or more inflatable air sacks 10 for considerations of safety and, furthermore, each inflatable air sack 10 has an input/output air stem 11 respectively projecting from the outer surface of the water skiing float 1; the jacket 2 is constructed of nylon or other similar material that is externally sleeved around the water skiing float 1 and has towing cord rings 20 and a pull mount 21 disposed along its outer surface, which protects the water skiing float 1 and provides for user hauling and grasping, and disposed in alignment with the input/output air stems 11 projecting from the water skiing float 1 are through-holes 25 of identical size such that after the through-holes 25 are fitted over the input/output air stems 11, sealing retainers 26 are installed to clip the jacket 2 onto the water skiing float 1 and, furthermore, when the jacket 2 is sleeved around the water skiing float 1, there are round, tooth-shaped ligature openings 22 in an alternating arrangement along its interior edge, with each ligature opening 22 having a perforation 23 at its lateral margin through which a rope 24 is threaded for binding and attachment around the inside of the water skiing float 1.

During actual utilization, following the sleeving of the jacket 2 onto the water skiing float 1, the rope 24 is serially inserted through the perforations 23 along the edges of the ligature openings 22 and then tied and, furthermore, the sealing retainers 26 are secured onto the input/output air stems 11 to clip the jacket 2 onto the water skiing float 1 such that when the water skiing float 1 is towed at high speed or utilized in powerful currents, the imposition of imbalanced or excessive pulling forces do not give rise to movement between the jacket 2 and water skiing float 1 due to the respective constraint and clipping of the input/output air stems 11 and the sealing retainers 26 and, furthermore, the ligature openings 22 resist tearing easily because the rope 24 is tightly threaded through the perforations 23 of the round, tooth-shaped, and alternating ligature openings 22, thereby increasing safety and preventing injury.

In summation of the foregoing section, although the examples presented above only represent some of the embodiments of the invention herein, they shall not be construed as limitation of the present invention and, therefore, all modification and adaptations based on the innovative spirit and features of the invention herein shall be protected within the claims of the present invention.

What is claimed is:

1. A water skiing float and jacket comprising:

a) a water skiing float having a plurality of inflatable air sacks, each inflatable air sack having an input/output air stem and a sealing retainer;

b) a jacket encasing the water skiing float, the jacket having:

i) a plurality of alternating tooth-shaped ligature openings along opposing interior edges of the jacket, each tooth-shaped ligature opening having a perforation; and ii) a plurality of holes, each hole receiving one input/output air stem, each input/output air stem being connected to the jacket by the sealing retainer; and c) a rope threaded through the perforations of the plurality of alternating tooth-shaped ligature openings such that plurality of alternating tooth-shaped ligature openings along opposing interior edges of the jacket become meshed thereby securing the air sacks within the jacket.

2. The water skiing float and jacket according to claim 1, further comprising a plurality of towing cord rings and a pull mount on the jacket.

* * * * *